US010507373B2

(12) United States Patent
Lehrer et al.

(10) Patent No.: US 10,507,373 B2
(45) Date of Patent: Dec. 17, 2019

(54) AUTOMATIC JUDGING SYSTEM FOR CLIMBING WALL COMPETITION

(71) Applicants: Benjamin R. Lehrer, Merion Station, PA (US); Jonathan S. Roach, Philadelphia, PA (US)

(72) Inventors: Benjamin R. Lehrer, Merion Station, PA (US); Jonathan S. Roach, Philadelphia, PA (US)

( * ) Notice: Subject to any disclaimer, the term of this patent is extended or adjusted under 35 U.S.C. 154(b) by 150 days.

(21) Appl. No.: 15/838,692

(22) Filed: Dec. 12, 2017

(65) Prior Publication Data

US 2019/0176011 A1 Jun. 13, 2019

(51) Int. Cl.

| | |
|---|---|
| ***A63B 71/06*** | (2006.01) |
| ***A63B 69/00*** | (2006.01) |
| ***A63B 24/00*** | (2006.01) |

(52) U.S. Cl.

CPC ..... *A63B 71/0605* (2013.01); *A63B 24/0062* (2013.01); *A63B 69/0048* (2013.01); *A63B 71/0622* (2013.01); *A63B 2071/0625* (2013.01); *A63B 2071/0694* (2013.01); *A63B 2207/02* (2013.01); *A63B 2209/10* (2013.01); *A63B 2225/50* (2013.01); *A63B 2225/54* (2013.01)

(58) Field of Classification Search

None

See application file for complete search history.

(56) References Cited

U.S. PATENT DOCUMENTS

| | | | | |
|---|---|---|---|---|
| 7,274,292 | B2 * | 9/2007 | Velhal | G08B 21/0227 340/10.2 |
| 8,717,165 | B2 * | 5/2014 | Gernandt | G06K 19/0705 340/539.13 |
| 8,792,869 | B2 * | 7/2014 | Prentice | G01S 5/14 455/41.2 |
| 9,311,586 | B2 * | 4/2016 | Robinette | G08B 13/1427 |

* cited by examiner

*Primary Examiner* — Ronald Laneau

(74) *Attorney, Agent, or Firm* — Norman E. Lehrer; Emmett S. Collazo

(57) ABSTRACT

An automatic judging and display system for rock climbing competition includes a rock climbing wall with a plurality of spaced apart holds secured thereto. One set of holds is associated with a first color and another set of holds is associated with a different color. An RFID tag is located on the wall immediately beneath each hold and uniquely identifies that hold. The climber carries an RFID tag reader on his or her wrist which wirelessly transmits information to a computer system which then analyzes and records the signal and sends it to a display mounted adjacent the top of the wall to be viewed by spectators.

8 Claims, 3 Drawing Sheets

AUTOMATIC JUDGING SYSTEM FOR CLIMBING WALL COMPETITION

BACKGROUND OF THE INVENTION

The present invention is directed a climbing wall judging system and more particularly toward a system for automatically judging and scoring the progress of a climber climbing a rock wall in a rock climbing gym.

Since at least the 1980's, artificial structures commonly referred to as climbing walls have been known. They allow indoor rock climbing in urban areas, most of the time in closed areas such as a gymnasium or rock gyms. A climbing wall is constructed of a bearing structure, generally made out of concrete or plywood or other strong material, with surfaces that are generally vertical, but which can also include different structures such as overhangs or inclined walls. Fixed or detachable climbing holds are set on these climbing walls.

The climbing holds are made of various shapes having a first part that is designed to receive the hand or the foot of a climber in order to be used as a support. A second part of the hold, integral with the first part, is usually equipped with a male screw or bolt that attaches to the climbing wall. The difficulty of the progression on the climbing wall comes from the placement and spacing of the holds compared to each other and from the shape of the holds. For example, some may be easy to grasp while others may be more difficult.

On a climbing wall, a variety of climbing routes are established by different color coding of the holds themselves, or by labels that are attached to the wall next to the holds. In competition (or in practice) a climber chooses or is assigned a particular colored route to follow. There may be eight or ten or more holds of the particular color and the climber must use only the assigned colored holds when climbing from the bottom to the uppermost hold of the particular color. Touching a hold of the wrong color during the climb is not permitted.

During each climb, a judge is assigned to watch the climber. The climber loses points or is disqualified if he or she touches the wrong colored hold or falls off the wall. In most competitions, the climber's score depends on the highest hold that he or she properly reaches. Obviously, the highest score is awarded if the climber reaches the uppermost assigned colored hold without touching a hold of a different color. After the climb, the judge records the climber's score at a central place which is commonly a computer system. The judge must, of course, enter the climber's name and his or her score. Because both the scoring and the entry into the computer system are done manually, errors can and do occur. It is also sometimes difficult to find enough qualified judges as numerous climbers may be climbing simultaneously. Even further, the judge's view may be obstructed by the climber's body whereby he or she may not accurately see or may misinterpret an action of the climber.

Indoor rock climbing is also a spectator sport. During the climb, other climbers and friends and family watch as the climber ascends the rock wall. However, in a crowded gym with limited space, the spectators cannot always see exactly how a climber is doing. Their view may be blocked at times and they may not be able to observe the climber's progress.

There is, therefore, a need for a system that automatically tracks a climber and scores his or her results and enters the same in a computer system without the need for a judge.

There is also a need for an automatic system that tracks and displays a climber's progress so that spectators can observe the same.

SUMMARY OF THE INVENTION

The present invention is designed to overcome the deficiencies of the prior art discussed above. It is an object of the present invention to provide an automatic judging and display system for rock climbing competition.

It is a further object of the present invention to provide an automatic judging and display system for rock climbing competition that includes a computer system for automatically tracking and recording the progress of a climber.

It is an even further object of the present invention to provide an automatic judging and display system for rock climbing competition that not only automatically tracks a climber but also displays the same on a display for spectators to follow.

In accordance with the illustrative embodiment demonstrating features and advantages of the present invention, there is provided an automatic judging and display system for rock climbing competition that includes a rock climbing wall with a plurality of spaced apart holds secured thereto. One set of holds is associated with a first color and another set of holds is associated with a different color. An RFID tag is located on the wall immediately beneath each hold and uniquely identifies that hold. The climber carries an RFID tag reader on his or her wrist which wirelessly transmits information to a computer system which then analyzes and records the signal and sends it to a display mounted adjacent the top of the wall to be viewed by spectators.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
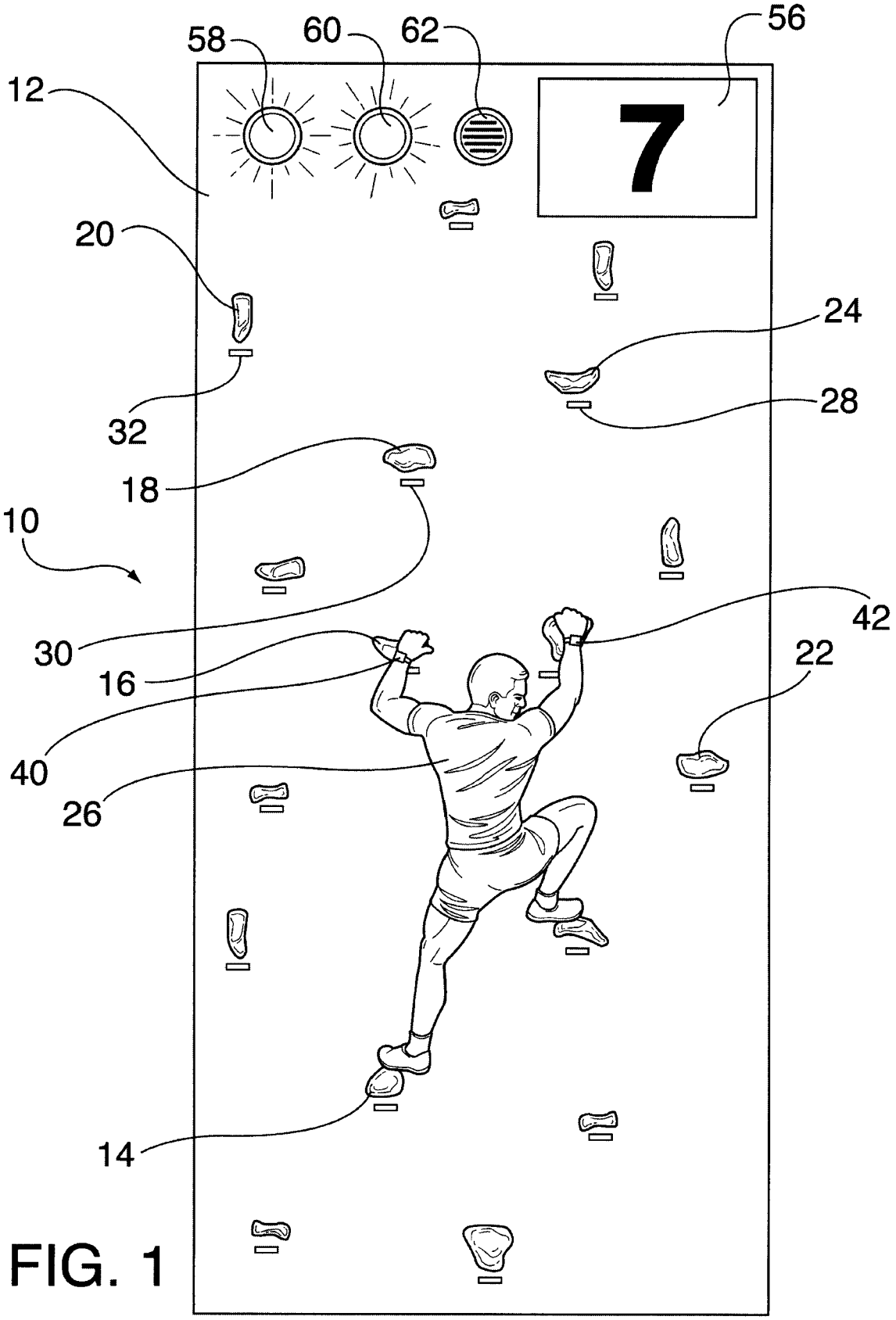
FIG. 1 is a front view, of a rock climbing wall forming a part of the present invention.

Referring now to the drawings in detail wherein like reference numerals have been used throughout the various figures to designate like elements, there is shown in FIG. 1 a climbing wall constructed in accordance with the principles of the present invention and designated generally as 10. With the exception of the added features and elements described below, the climbing wall 10 is essentially the same as any conventional climbing wall well known in the art. In fact, any existing climbing wall can be easily modified to incorporate the inventive features of the present invention.

As is known in the art, the climbing wall 10 includes a substantially vertically extending rigid support 12 having a number of holds such as shown at 14, 16, 18, 20, 22 and 24, secured thereto. These holds are marked with colors to present different paths or routes for the climber 26 to follow. For example, holds 14, 16, 18, and 20 may be marked with a red color while holds 22 and 24 may be marked with a yellow color. In competition, the climber chooses a colored route and must follow the same to the top without touching a hold of a different color.

Located on the support 12 and directly beneath each hold is a radio frequency identification (RFID) tag such as shown, for example, at 28, 30 and 32. Each tag is associated with a different hold and identifies that hold and only that hold. As shown, RFID tag 28 identifies hold 24, tag 30 identifies hold 18 and tag 32 identifies hold 20.

Figure 4:
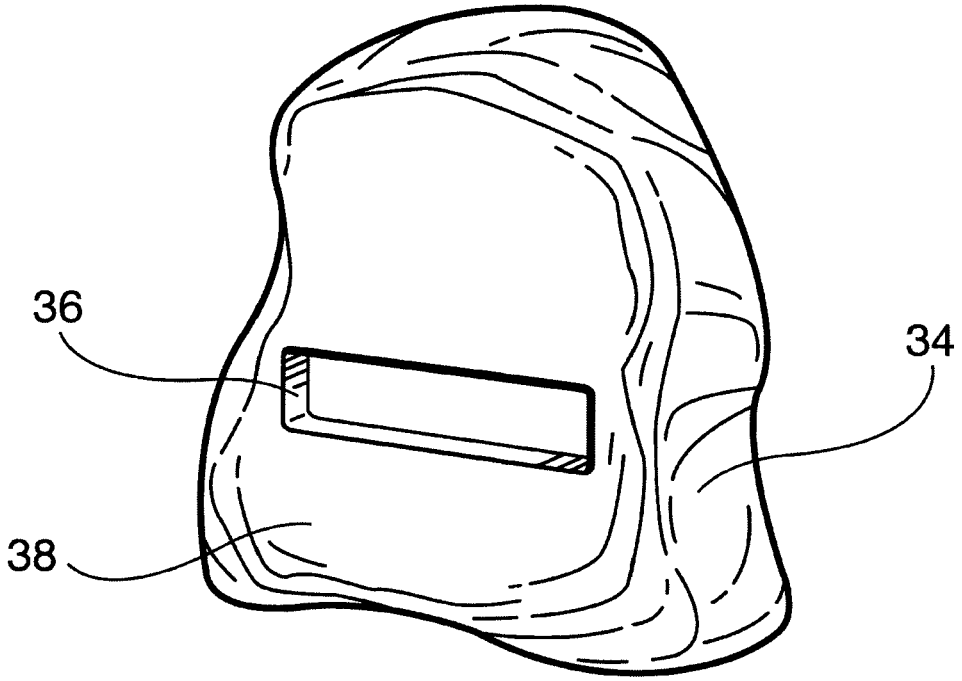
FIG. 4 is a rear perspective view of one of the climbing holds showing an alternative embodiment of a part of the invention.
Figure 3:
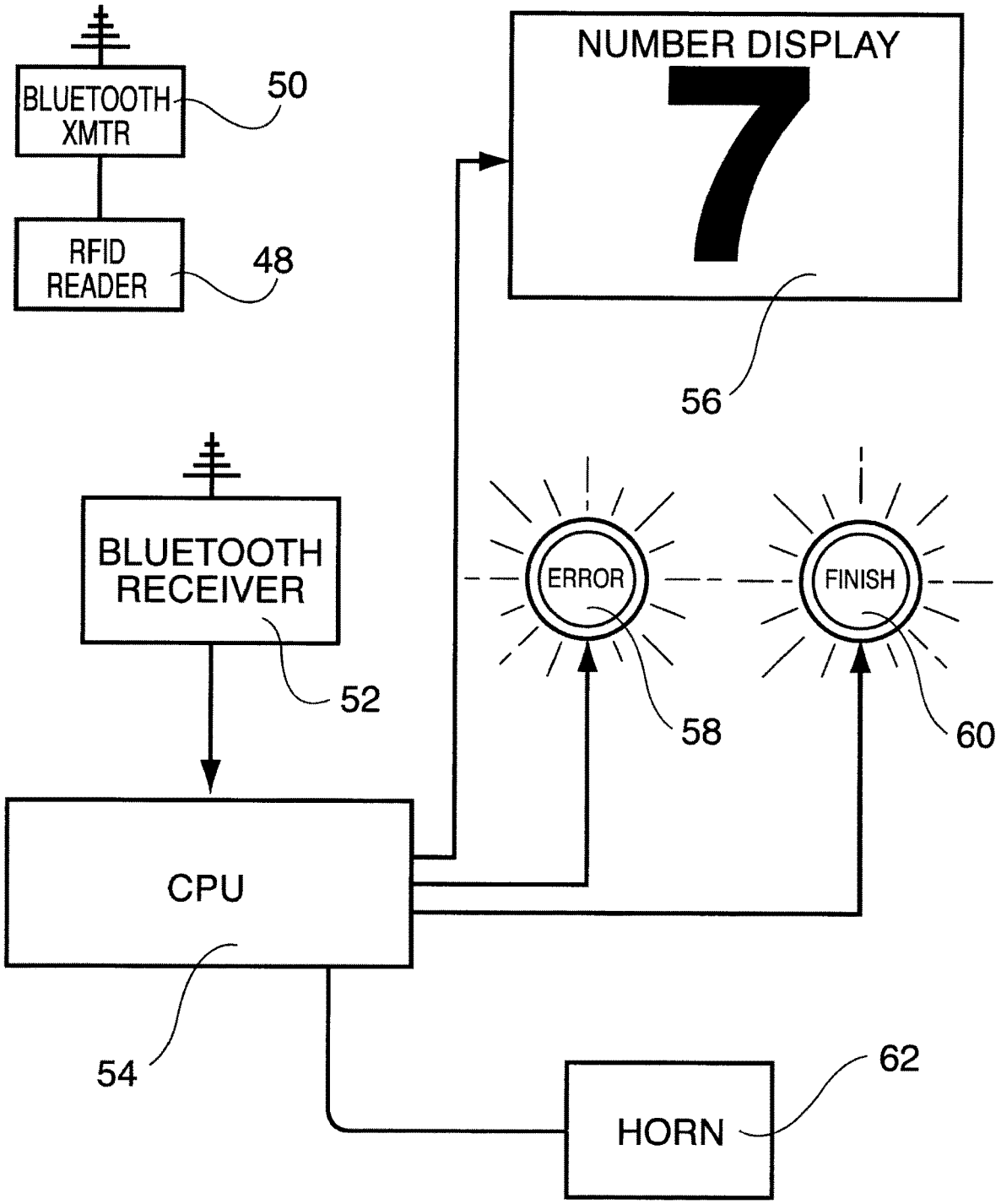
FIG. 3 is a schematic representation of the electronics of the invention.

In a second modified form of the invention, the RFID tags could be integral with and located within the hold. This is shown, for example, in FIG. 4 wherein the hold 34 includes a cavity or recess 36 in the rear wall 38 thereof. An RFID tag could be inserted into the cavity 36 before the hold 34 is attached to the support 12 of the climbing wall 10.

Figure 2:
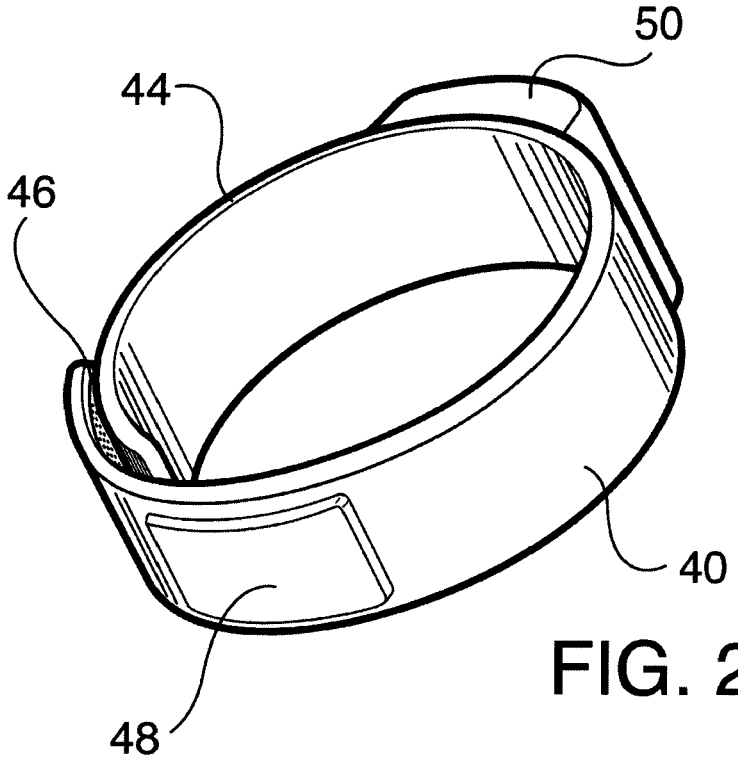
FIG. 2 is a view of a wrist band RFID reader worn by a climber utilizing the invention.

In order to track and record the progress of the climber 26 as he or she ascends the wall 10, wristbands or cuffs 40 and 42 are worn on his or her wrists. The two wristbands are essentially the same. Accordingly, only one will be described in detail. It is understood that the other wristband is constructed in essentially the same manner. As shown most clearly in FIG. 2, the wrist band may be comprised of a flexible fabric material 44 that wraps around the climber's wrist and is secured thereto through the use of Velcro or the like.

An RFID tag reader 48 is carried by the wrist band 40 and, as is known in the art, is capable of reading and identifying an RFID tag into which it is brought into close proximity. For this reason, when the wrist band 40 is worn by the climber 26, it is oriented so that the reader 48 is on the inside of the wrist below the palm. In this way, as the climber grabs a hold, the RFID reader will directly overly the tag associated with that hold. In some applications, it may also be necessary to provide ankle bands similar to the wristbands so that the system can identify the hold that the climber's foot is engaging. In such cases, it might be necessary to add an additional RFID tag above each hold so that it can be read by the ankle band.

The wrist band 40 also carries a wireless transmitter 50 and the necessary electronic circuits to interpret the information from the RFID reader 48 and transmit that information. Preferably, the wireless transmitter 50 utilizes Bluetooth technology but other systems are, of course, also possible. So as not to interfere with the climber's ability to climb, the transmitter 50 an associated electronics are preferably mounted on the opposite side of the wrist band 40. It will, therefore, be located on the back of the climber's wrist when worn.

The signals from the transmitter 50 are received by the Bluetooth receiver 52 and are then sent to the CPU 54. The CPU is preferably an Arduino or similar microcontroller but other computer systems could obviously be utilized. The CPU 54 is preprogrammed to know which RFID tags are associated with which colored route. The CPU 54 also knows whether a particular tag is the first or second or third, etc. tag from the bottom in the particular colored series. As the climber 26 ascends the wall 10, the CPU displays the number of the selected colored holds in the number display 56. The display 56 is preferably mounted near the top of the climbing wall 10 and is large enough for spectators on the ground to see.

In the event that a climber 26 touches one of the holds that is not in the selected colored route, the CPU will identify that fault and will light the error or fault light 58 which is also preferably located near the top of the climbing wall 10. The fault light 58 will also be lit if the climber falls off the wall. This can be accomplished by having an additional RFID tag at the bottom of the wall that will be sensed by the RFID reader 48 in the event of a fall or by some other type of sensor such as a photoelectric sensor or the like.

If, however, the climber 26 reaches the top of the wall by touching the uppermost hold in the selected colored series, the finish light 60 will be illuminated. The finish light is also preferably mounted near the top of the wall 10. In addition to lighting the fault light 58 or the finish light 60, it is also possible to have a horn or bell 62 or other sounding device that will audibly announce that the climber has faulted or reached the top. A different sound, of course, could indicate either a fault or success.

The colored route to be climbed can be selected in different ways. Before climbing, the climber 26 can manually enter his or her choice into the system or can advise the judge who can enter the information. Alternatively, the selected route can be identified by the first hold that is used by the climber. That is, if the first hold touched by a climber is red, the selected route is red and the climber must continue up the same red route.

The CPU can also be used to identify the climber. Information relating to the identity of the climber can be entered manually or each climber can have his or her own wrist band 40 which will send identifying information to the CPU. Each climber's results can then be tallied by the CPU or the information can be sent to another computer system that receives similar information from multiple climbing walls. The computer system can then keep track of all climbers and rank them in accordance with preselected criteria.

The present invention may be embodied in other specific forms without departing from the spirit or essential attributes thereof and accordingly, reference should be made to the appended claims rather than to the foregoing specification as indicating the scope of the invention.

We claim:

1. An automatic judging and display system for rock climbing competition comprising:

a rock climbing wall;

first and second sets of spaced apart holds secured to said wall, each of said sets including a plurality of holds, said first set of holds being associated with a first color and said second set of holds being associated with a second color, different from said first color;

a plurality of distinct RFID tags, each tag having a different identification associated therewith, each tag being located near and associated with a different hold, each tag uniquely identifying only the hold to which it is associated;

an RFID tag reader, said tag reader being capable of separately identifying each of said tags and including means for wirelessly transmitting a signal containing information relating to a tag when brought into the vicinity of said tag;

a computer system, said computer system being capable of receiving signals from said RFID tag reader and analyzing said signals, and means for attaching said RFID tag reader to a climber's body.

2. The automatic judging and display system for rock climbing competition as claimed in claim 1 wherein said means for attaching said RFID tag reader to said climber's body includes a wrist band for attaching said reader to one of said climber's wrists.

3. The automatic judging and display system for rock climbing competition as claimed in claim 2 including a second RFID tag reader and a second wrist band for attaching said second reader to the other of said climber's wrists.

4. The automatic judging and display system for rock climbing competition as claimed in claim 1 wherein said RFID tags are integral with said holds.

5. The automatic judging and display system for rock climbing competition as claimed in claim 4 wherein each of said holds includes a cavity therein and wherein said RFID tags are located within said cavities.

6. The automatic judging and display system for rock climbing competition as claimed in claim 1 wherein said RFID tags are mounted to said climbing wall directly beneath each hold.

7. The automatic judging and display system for rock climbing competition as claimed in claim 1 further including a display connected to said computer system for displaying to spectators the progress of a climber.

8. The automatic judging and display system for rock climbing competition as claimed in claim 7 wherein said display is secured to the upper part of said rock wall.

* * * * *